US008414424B2

(12) United States Patent
Hebert et al.

(10) Patent No.: US 8,414,424 B2
(45) Date of Patent: Apr. 9, 2013

(54) ANTI-COUNTERFEITING SYSTEM USING COMPOUND ADDITIVES

(75) Inventors: Edmund A. Hebert, Mattapoisett, MA (US); William B. Lacy, Plymouth, MA (US)

(73) Assignee: Acushnet Company, Fairhaven, MA (US)

( * ) Notice: Subject to any disclaimer, the term of this patent is extended or adjusted under 35 U.S.C. 154(b) by 714 days.

(21) Appl. No.: 11/940,420

(22) Filed: Nov. 15, 2007

(65) Prior Publication Data

US 2008/0139342 A1 Jun. 12, 2008

Related U.S. Application Data

(60) Provisional application No. 60/869,634, filed on Dec. 12, 2006.

(51) Int. Cl.
*A63B 37/06* (2006.01)

(52) U.S. Cl.
USPC ..... 473/353

(58) Field of Classification Search ..... 473/378, 473/353
See application file for complete search history.

(56) References Cited

U.S. PATENT DOCUMENTS

| | | | | |
|---|---|---|---|---|
| 5,145,750 | A | 9/1992 | Davis et al. | |
| 5,585,460 | A | 12/1996 | Yamada et al. | |
| 5,811,822 | A | 9/1998 | Huston et al. | |
| 6,211,526 | B1 | 4/2001 | Huston et al. | |
| 6,325,731 | B1 * | 12/2001 | Kennedy et al. | 473/377 |
| 6,647,649 | B2 | 11/2003 | Hunt et al. | |
| 7,394,997 | B2 * | 7/2008 | Mei et al. | 399/12 |
| 2007/0144365 | A1 * | 6/2007 | Pulvino et al. | 101/41 |

OTHER PUBLICATIONS

"Compounders Thwart Counterfeiting with Covert Additive Techniques"; Toensmeier, Patrick a.; Plastics Engineering Sep. 2005; pp. 10-12.

* cited by examiner

*Primary Examiner* — Raeann Gorden
(74) *Attorney, Agent, or Firm* — William B. Lacy

(57) ABSTRACT

A golf ball comprising a core and a cover layer. The cover layer, clearcoat, or indicia include an additive, invisible to the naked eye without an external excitation source, the additive including an engineered taggant formed from a crosslinked melamine and rare earth elements.

9 Claims, No Drawings

ANTI-COUNTERFEITING SYSTEM USING COMPOUND ADDITIVES

CROSS-REFERENCE TO RELATED APPLICATIONS

This application claims priority to U.S. Provisional Patent Application Ser. No. 60/869,634, filed Dec. 12, 2006.

FIELD OF THE INVENTION

The invention relates generally to anti-counterfeiting systems using compound additives and, in particular, addition of specifically formulated covert additives to golf component parts, such as golf ball, club, or shoe component layers, paints, or ink systems, to enable positive identification as an authentic product.

BACKGROUND OF THE INVENTION

Golf equipment counterfeiting represents a multi-million dollar industry, and one that has impact on all legitimate product manufacturers. Many of these manufacturers have investigated countermeasures to deter counterfeiters, including covert packaging markings, inks, holograms (and possibly other means of protection of which the inventor is unaware).

Obviously, labels that are not apparent to the naked eye are desired for many manufactured articles and materials, including golf balls. However, the 'marking' of products in a manner that is not obvious to the unscrupulous counterfeiter, yet that are robust enough to remain on the product without any deleterious effects, is not a trivial matter. Labels must be flexible in their applicability and as robust as possible. For instance, it is desirable to make labels that can be applied with dyes, inks, stains, shellacs, varnishes, glazes, polymer coatings, and other coatings or materials for application to an article or product. It is also desirable to make such labels robust so that, for instance, they can survive exposure to moderately high temperatures and common solvents, as well as have high impact resistance. Suitable labels must also be non-toxic and have some type of redundancy built into them—that is, the labels should be able to be read in more than one way, as a double check on the authenticity of a labeled article.

Since labels generally require some type of coding (i.e., bar coding, alphanumeric coding, etc.), it is desirable to have such coding on a label that is likewise not visible to the naked eye. In practice today, this is often done by putting a "hidden" number, code, or serial number, for example, in some discreet location on an article, such as inside a case or housing. Unfortunately, such placement is inherently difficult to access when it is desired to read the label. It would be preferred to have coding that is hidden in plain sight. Coding that requires stimulation for readability would satisfy this need.

It is also desirable to have a way of monitoring some time entity or time relationship for labeled articles, such as shipping time or shelf time. A label that included some type of timing capability would satisfy this need. Optimally, such a timing system would have a broad range, being able to time over scales of days, weeks, months, or years, as needed.

This invention calls for incorporation of signature anti-counterfeiting additives into the product itself, via a compound, masterbatch, component, ink or paint system, or other appropriate manufacturing process step. In this manner, the tag is integral to the product, and could not be separated.

Further, the addition of a portable scanning system capable of validating the presence of these additives (be it deployed as an in-shop kiosk, a hand-held scanner given to sales reps or pros, or some other means of distribution) would provide a means for the customer or consumer to quickly feel comfortable with the authenticity of their product at the point of purchase.

SUMMARY OF THE INVENTION

The present invention is directed to a golf ball comprising a center and a cover layer, wherein the cover layer has an outer surface comprising indicia, invisible to the naked eye without an external excitation source, formed from an engineered taggant derived from melamine particles and rare earth elements, or an inert chemical tracer.

The present invention is also directed to a golf club comprising indicia, invisible to the naked eye, formed from an engineered taggant derived from melamine particles and rare earth elements, or an inert chemical tracer.

The present invention is further directed to a package for enclosing golf balls, the package comprising indicia, invisible to the naked eye, formed from an engineered taggant derived from melamine particles and rare earth elements, or an inert chemical tracer.

The present invention is directed to a golf ball comprising a core; and a cover layer comprising an additive, invisible to the naked eye, the additive comprising an engineered taggant. The taggant is preferably derived from crosslinked melamine and rare earth elements. The taggant also typically includes a plurality of wafers, preferably 10 wafers, and has an outer diameter of 20 μm to 600 μm. To be invisible to the naked eye, the taggant has an excitation wavelength in the infrared spectrum and an emission wavelength in the visible spectrum.

In one embodiment, the cover layer is a clearcoat layer. Alternatively, the taggant may be indicia. The additive further may further include an inert chemical tracer or an optically-stimulable glass powder. The additive may also further include a nanoparticle, a spectral material, an elemental material, or a infrared material.

In another embodiment, the golf ball further includes an inner cover comprising an ionomer or a partially- or fully-neutralized ionomer, and the outer cover comprises a polyurethane or a polyurea material. Preferably, the inner cover layer has a hardness of 40 Shore D to 75 Shore D, more preferably 65 Shore D to 70 Shore D. The inner cover layer has a thickness of 0.02 inches to 0.04 inches. A combination of the core and the inner cover layer has an outer diameter of 1.51 inches to 1.64 inches. The cover layer has a hardness of 60 Shore D or less, preferably 20 Shore D to 55 Shore D. The outer cover layer has a thickness of 0.02 inches to 0.05 inches.

The present invention is also directed to a golf ball comprising a core having a diameter of 1.50 inches or greater; an intermediate layer; an outer cover layer comprising a polyurethane or a polyurea material; and an additive, invisible to the naked eye without an external excitation source, the additive comprising an engineered taggant formed from a plurality of wafers derived from crosslinked melamine and rare earth element; wherein the a combination of the core and the inner cover layer have an outer diameter of 1.51 inches to 1.64 inches and the taggant has an excitation wavelength in the infrared spectrum and an emission wavelength in the visible spectrum.

DESCRIPTION OF THE PREFERRED EMBODIMENTS

The invention is directed to incorporation of fluorescent anti-counterfeiting additives into a product, preferably a golf ball or packaging therefore, via a compound, masterbatch, component, ink or paint system, or other appropriate manufacturing process step. In this manner, the anti-counterfeiting tag is integral to the product, and cannot be separated.

In a preferred embodiment, the addition of specifically formulated covert additives to golf component parts (such as golf ball cover layers or golf club paint systems) enable positive identification as an authentic product. The additive may be in the form of an engineered taggant (derived from melamine particles and rare earth elements) or an inert chemical tracer. Each of these emerging technologies represents an inexpensive way of positively identifying authentic product.

In an alternative embodiment, the present invention may be combined or utilized with an 'in-shop kiosk' housing appropriate portable scanning technology calibrated to identify the specific taggants in the golf products. This embodiment would allow a unique, interactive way for a buyer or end-user (consumer) to confirm that their purchase was authentic.

The product component, coating, and/or decoration layers (i.e., indicia) is doped with specific formula of quantities of taggants, each carrying a unique profile of fluorescent (or alternative wavelength) emission. Some of these tags might fluoresce back in the visible spectrum (for easy visual identification), while others might fluoresce at an infrared frequency (invisible to the naked eye). Some taggants might be deployed in a paint system, while others are included in an ink system (further complicating an attempt by a counterfeiter to emulate the process).

A remote detector, similar in appearance to a television remote control, can be programmed to detect the presence and specific concentration of taggants included in the formulation. Such a combination of multiple IR to visible and IR-IR fluorescent taggants would create a "combination lock" that would be extremely difficult to counterfeit via reverse engineering.

These chemical taggants are inert compounds, typically added to a masterbatch, paint, or ink system. The additives are typically one or more fluorescent taggants or tracers that fluoresce (or emit light) at a specific wavelength. Detection of these additives allow confirmation of the correct presence and concentration of all taggants included in the formulation. Once a series of taggants are adapted and formulated into authentic product, then the "combination to the lock" becomes unique to that product or manufacturer.

This invention deals specifically with the incorporation of two emerging technologies in counterfeiting deterrence—microtaggant identification particles ("taggants") and inert chemical compounds ("tracers"). Taggants are multicolored particles, derived from crosslinked melamine and rare earth elements that are added to component masterbatches in the manufacturing process. These particles range in size from less than 20 microns to greater than 600 microns. These particles are typically constructed as a multilayered (i.e., 10-layered) wafer structure, and can be manufactured with a unique numeric/color code for a specific product. Each layer has a unique numeric/color value, and codes are assigned to manufacturers or products. Suitable taggants are commercially-available from MicroTrace, LLC of Minneapolis, Minn. The unique combinations of colors or numbered layers is virtually limitless. The tag can be made more complex through the addition of nanoparticles to the structure, or through the inclusion of spectral, elemental, or infrared materials that emit a specific signature when scanned.

Chemical tracers aren't as physically sophisticated as taggants in their composition (they are inert chemical compounds added to a masterbatch), however, they still provide a high degree of covert protection that is highly difficult to duplicate.

Both types of additives have no deleterious effect on the performance or processability of the materials they are blended with, and are suitable for use in transparent or opaque materials in molding or extrusion processes.

These technologies can be detected in a variety of ways, including laser scanner, UV light, and spectroscopic analysis. The additives are designed to be simple to identify in the field by law enforcement or customs agents, via hand scanners, UV lights, electronic detectors, or laser devices that can detect the presence of the material as effectively as a laboratory analysis. The ease of identification is not a concern because the identification step is not the "key" to unlock the "code" defining a product as counterfeit or not—the spectral excitation and response of the taggant provides the authenticity information.

Another alternative embodiment of the present invention relates generally to invisible means for marking golf balls and other articles, such as golf ball packaging, using luminescent and optically-stimulable glasses. More particularly, the alternative embodiment relates to using metal-ion dopants in a glassy matrix in inks, dyes, and the like, for marking golf balls and packaging, and for detecting these by fluorescence and optically-stimulated readout of trapped states.

The particular glasses and additives selected will depend on the properties desired, such as (1) the color of the prompt luminescence or the optically stimulated luminescence, (2) the desired trap lifetime, or desired combination of lifetimes, and (3) the desired physical properties of the glass, such as porosity, and the associated diffusivity.

A typical embodiment of the invention uses a glass (or glass matrix) containing an alkaline earth sulfide (i.e., MgS, CaS, SrS, and BaS) doped with an activator/co-activator pair of rare earth elements (i.e., samarium, europium, and cerium). Suitable glasses for this embodiment of the invention include porous Vycorm glass, fused quartz, fused silica, alumina glass, or borate glass. Glass matrices (i.e., silica, alumina, or borate glass) may be doped with ZnS and Cu, Pb, Mn, Ce, Ag, or Eu. Preferably the glasses are essentially free of metal sulfides or sulfides.

These optically-stimulated luminescent (OSL) glasses are typically are prepared by diffusing the dopants into the glass or glass matrices, which may be either porous or fused (non-porous). The dopants may be diffused into the glass matrix by a wide variety of methods, such as by solution contact (for a sufficiently long time to allow diffusion) followed by drying. A soluble salt of a generally insoluble metal sulfide component may also be used. After drying, the glass may be sulfided, consolidated, and activated.

In fused silica or quartz glass, the dopants may be diffused by dipping the fused silica or quartz glass matrix into an organic-inorganic sol gel including a salt or salts of the dopant metals and slowly withdrawn, resulting in the formation of a porous, thin (<1 μm) film containing the salt or salts. Upon drying, the organic constituents of the film volatilize and/or decompose, leaving behind a porous, film containing the salts (which then may be sulfided to provide metal sulfides) that is then activated.

The dopant salts used in the solutions and sol gels discussed above are typically selected so that the salt is soluble in the solution or sol gel and the anion component of the salt, upon reduction, forms a gas or mixture of gases that are non-reactive, or beneficially reactive, with the doped glass matrix. The concentrations of these salts in the sol gels and solutions may vary widely. For example, each salt is typically present at a concentration of about 0.001 g/100 ml solution.

The doped glass matrix provides a mechanically robust, chemically inert phosphor material. The material withstands cycling through temperature extremes of up to 1200° C., without any apparent loss in performance.

OSL glass powders may be disposed in some other material. OSL glass powders may be blended with polymers, such as ionomers, polyurethanes, polyureas, polyethylenes, polycarbonates, silicones, polymethylmethacrylates, acrylic acids, and polyvinyl chlorides. The polymers may then be applied as a coating onto an article or formed into a golf ball component. Preferably, the indices of refraction of the glass and the polymer are similar, typically in the range of about 1.4 and 1.5. OSL glass also may be added to inks, stains, shellacs, varnishes, glazes, paints, conventional dyes, or even synthetic fibers, such as polyester or rayon, for inclusion in fabric articles.

Whatever the morphology of the glass, the methods for exciting the glass for prompt luminescence and for trap formation will be the same in most cases. Typically, an article is marked with a patterned label (i.e., bar code, hob, date, serial number, etc.) including a powdered glass phosphor pattern according to the invention and is illuminated with a UV light source. This illumination excites prompt luminescence and, depending on the wavelength, populate traps. The prompt luminescence typically is filtered through a blue-green color glass filter and detected with a detector, such as a CCD camera. The resulting image may be viewed on a computer screen or may be printed directly from the camera unit.

To observe an OSL image, the patterned label must first be energized using a short wavelength UV source to cause electrons to be trapped. While the effect of UV excitation varies with wavelength, suitable UV excitation ranges from about 100 nm to about 400 nm. Preferred UV excitation ranges from about 100 nm to about 280 nm, more preferably at about 185 nm and 254 nm. The trapped electrons then may be released by exposing the patterned label to an infrared light source. The released charges may then recombine, and thereby emit photons. The resulting optically-stimulated luminescence can be viewed with an OSL detector.

Patterned emission will be a useful feature of the invention, especially for coding applications. The invention may be used to put, for example, an alphanumeric code, bar code, trademark, symbol, logo, or other product identifier, on an article, by making this code visible upon UV stimulation for prompt luminescence and/or the code may also be made visible by near-IR/IR stimulation of the OSL. The patterns may be written by patterned application of the marking material and/or by patterned excitation of the marking material by exposure to patterned short wavelength UV light. Handheld laser scanners, similar to the ones in use for bar code reading, may be used for exposing and viewing patterned luminescence. One or two directional scanning may be used according to the invention, depending on the emission pattern.

The marking material may include a matrix of some bulk material. The OSL glass may be added to the bulk material by any suitable method, such as coating the OSL glass onto the bulk material, mixing it with the bulk material, embedding it into the bulk material, or combinations of these. A wide range of bulk materials may be used in the marking materials of the invention, including papers, polymers, glasses, fabrics, metals, ceramics, dyes, inks, stains, shellacs, varnishes, glazes, polymers, glasses including borosilicate glass, aluminosilicate glass, aluminoborosilicate glass, sealing glass, soda lime glass, and other glasses possessing an annealing point less than or equal to 800° C., and various combinations of these.

The marking material may be applied in a pattern by any of the available methods for applying a glass in any of the available morphologies in a pattern. Typically, this will mean applying a glass powder in a coating (i.e., an ink) through a mask or stencil, or with an ink jet. Alternatively, if the OSL glass is incorporated into a fiber, either a glass fiber or a fiber of another textile material, this fiber may be woven, sewn, or otherwise applied in a pattern to an article. Advantages of patterned application include the permanence of the pattern (once the pattern is made, it will endure for essentially the life of the article it is applied to), and the simplicity of excitation.

Patterned illumination will generally take place through a mask. Advantages of patterned illumination include the rewrite capability it entails and the simplicity of the initial manufacture. Objects coated with the marking material can be patterned using the mask technique or directly patterned using a spatially controlled UV light source such as a UV laser. Alternatively, the marking material may be used as a printing ink to apply specific patterns on objects.

Another useful feature of on embodiment the invention is the time scale of the phosphorescence. The glasses of the present invention will phosphoresce upon exposure to UV light. After removal of the UV excitation, this phosphorescence will decay slowly, over a time scale of seconds to tens of seconds, much longer than the rapid fadeout of fluorescent materials. Accordingly, one application of the present invention is to expose a label to UV light, and time the decay of the phosphorescence after the removal of the UV excitation. Comparing this fadeout to an expected fadeout will prove or disprove the presence of the OSL glasses used in the present invention, allowing one to potentially determine the presence of a counterfeit product or packaging.

Golf balls formed according to the invention may, for example, have a one-piece construction formed from a homogeneous mass consisting entirely of the polyurethane composition of the invention. Such balls may further include, if desired, blends of conventional golf ball cover and/or intermediate layer materials, such as those discussed herein or other materials available to those of ordinary skill in the art. One-piece balls formed with the materials disclosed herein are durable but do not provide great distance because of their relatively high spin and low velocity. Other embodiments of the present invention include two-piece, multi-layer construction, such as dual-core and dual-cover golf balls, and wound balls having cores, liquid centers, intermediate layers, and/or covers, with one or more of the layers including the polyurethane composition disclosed herein.

As used herein, the term "golf ball core" is used to refer to any portion of a golf ball surrounded by the cover. In the case of a golf ball having three or more layers, the term "golf ball core" includes at least one inner layer and typically refers to a center surrounded by at least one intermediate layer. Golf balls having at least two layers in the core are known as "dual core" golf balls. The center may be solid, gel-filled, hollow, or fluid-filled, e.g., gas or liquid. The term "inner core" is used interchangeably with "center" or "golf ball center," while the term "outer core" is used interchangeably with "intermediate layer" or "at least one intermediate layer." For example, one optional type of intermediate layer is a tensioned elastomeric material wound about the center. When a tensioned elastomeric material is included as an intermediate layer, the polyurethane compositions of the invention may be incorporated into the elastomeric material, the center, or both. An intermediate layer may be included within a ball having, for example, a single layer or multilayer cover, a single layer or multilayer core, both a single layer cover and core, or both a multilayer cover and a multilayer core, or any similar such combination.

Intermediate layers of the type described above are sometimes referred to in the art, and, thus, herein as well, as an inner cover layer, as an outer core layer, or as a mantle layer.

While any cover material would be suitable, preferably the golf ball of the present invention includes the reaction product of polyisocyanate, at least one polyol (or polyamine if a polyurea is desired), and at least one curing agent. Any polyisocyanate available to one of ordinary skill in the art is suitable for use according to the invention. Exemplary polyisocyanates include, but are not limited to, 4,4'-diphenylmethane diisocyanate ("MDI"), polymeric MDI, carbodiimide-modified liquid MDI, 4,4'-dicyclohexylmethane diisocyanate, p-phenylene diisocyanate ("PPDI"), m-phenylene diisocyanate, toluene diisocyanate ("TDI"), 3,3'-dimethyl-4,4'-biphenylene diisocyanate, isophoronediisocyanate, hexamethylene diisocyanate ("HDI"), naphthalene diisocyanate; xylene diisocyanate; p-tetramethylxylene diisocyanate; m-tetramethylxylene diisocyanate; ethylene diisocyanate; propylene-1,2-diisocyanate; tetramethylene-1,4-diisocyanate; cyclohexyl diisocyanate; dodecane-1,12-diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; methyl cyclohexylene diisocyanate; isocyanurate of HDI; triisocyanate of 2,4,4-trimethyl-1,6-hexane diisocyanate, tetracene diisocyanate, napthalene diisocyanate, anthracene diisocyanate, and mixtures thereof. Polyisocyanates are known to those of ordinary skill in the art as having more than one isocyanate group, e.g., di-, tri-, and tetra-isocyanate. Preferably, the polyisocyanate includes MDI, PPDI, TDI, or a mixture thereof, and more preferably, the polyisocyanate includes MDI. It should be understood that, as used herein, the term "MDI" includes 4,4'-diphenylmethane diisocyanate, polymeric MDI, carbodiimide-modified liquid MDI, and mixtures thereof and, additionally, that the diisocyanate employed may be "low free monomer," understood by one of ordinary skill in the art to have lower levels of "free" isocyanate monomer, typically less than about 0.1% to about 0.5% free monomer. Examples of "low free monomer" diisocyanates include, but are not limited to Low Free Monomer MDI, Low Free Monomer TDI, Low Free MPDI, and Low Free Monomer PPDI.

The at least one polyisocyanate should have less than about 14% unreacted NCO groups. Preferably, the at least one polyisocyanate has less than about 7.9% NCO, more preferably, between about 2.5% and about 7.8%, and most preferably, between about 4% to about 6.5%. Any polyol available to one of ordinary skill in the art is suitable for use according to the invention. Exemplary polyols include, but are not limited to, polyether polyols, hydroxy-terminated polybutadiene and partially/fully hydrogenated derivatives, polyester polyols, polycaprolactone polyols, and polycarbonate polyols. In one preferred embodiment, the polyol includes polyether polyol, more preferably those polyols that have the generic structure:

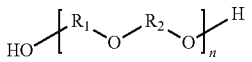

where $R_1$ and $R_2$ are straight or branched hydrocarbon chains, each containing from 1 to about 20 carbon atoms, and n ranges from 1 to about 45. Examples include, but are not limited to, polytetramethylene ether glycol, polyethylene propylene glycol, polyoxypropylene glycol, and mixtures thereof. The hydrocarbon chain can have saturated or unsaturated bonds and substituted or unsubstituted aromatic and cyclic groups. Preferably, the polyol of the present invention includes PTMEG.

In another embodiment, polyester polyols are included in the polyurethane material of the invention. Preferred polyester polyols have the generic structure:

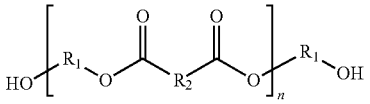

where $R_1$ and $R_2$ are straight or branched hydrocarbon chains, each containing from 1 to about 20-carbon atoms, and n ranges from 1 to about 25. Suitable polyester polyols include, but are not limited to, polyethylene adipate glycol, polybutylene adipate glycol, polyethylene propylene adipate glycol, ortho-phthalate-1,6-hexanediol, and mixtures thereof. The hydrocarbon chain can have saturated or unsaturated bonds, or substituted or unsubstituted aromatic and cyclic groups. In another embodiment, polycaprolactone polyols are included in the materials of the invention.

Preferably, any polycaprolactone polyols have the generic structure:

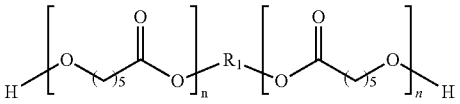

where $R_1$ is a straight chain or branched hydrocarbon chain containing from 1 to about 20 carbon atoms, and n is the chain length and ranges from 1 to about 20. Suitable polycaprolactone polyols include, but are not limited to, 1,6-hexanediol-initiated polycaprolactone, diethylene glycol initiated polycaprolactone, trimethylol propane initiated polycaprolactone, neopentyl glycol initiated polycaprolactone, 1,4-butanediol-initiated polycaprolactone, and mixtures thereof. The hydrocarbon chain can have saturated or unsaturated bonds, or substituted or unsubstituted aromatic and cyclic groups.

In yet another embodiment, the polycarbonate polyols are included in the polyurethane material of the invention. Preferably, any polycarbonate polyols have the generic structure:

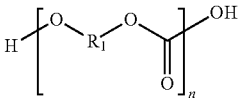

where $R_1$ is predominantly bisphenol A units —(P—$C_6H_4$)—$C(CH_3)_2$—(P—$C_6H_4$)— or derivatives thereof, and n is the chain length and ranges from 1 to about 20. Suitable polycarbonates include, but are not limited to, polyphthalate carbonate. The hydrocarbon chain can have saturated or unsaturated bonds, or substituted or unsubstituted aromatic and cyclic groups. In one embodiment, the molecular weight of the polyol is from about 200 to about 4000. Polyamine curatives are also suitable for use in the polyurethane composition of the invention and have been found to improve cut, shear, and impact resistance of the resultant balls. Preferred polyamine curatives have the general formula:

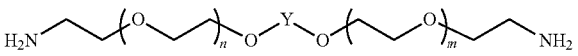

where n and m each separately have values of 0, 1, 2, or 3, and where Y is ortho-cyclohexyl, meta-cyclohexyl, para-cyclohexyl, ortho-phenylene, meta-phenylene, or para-phenylene, or a combination thereof. Preferred polyamine curatives include, but are not limited to, 3,5-dimethylthio-2,4-toluenediamine and isomers thereof (tradename ETHACURE 100 and/or ETHACURE 100 LC); 3,5-diethyltoluene-2,4-diamine and isomers thereof, such as 3,5-diethyltoluene-2,6-diamine; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline); trimethylene glycol-di-p-aminobenzoate; polytetramethyleneoxide-di-p-aminobenzoate; N,N'-dialkyl-diamino diphenyl methane; para, para'-methylene dianiline (MDA), m-phenylenediamine (MPDA), 4,4'-methylene-bis-(2-chloroaniline) (MOCA), 4,4'-methylene-bis-(2,6-diethylaniline), 4,4'-diamino-3,3'-diethyl-5,5'-dimethyl diphenylmethane, 2,2',3,3'-tetrachloro diamino diphenylmethane, 4,4'-methylene-bis-(3-chloro-2,6-diethylaniline), (LONZACURE M-CDEA), trimethylene glycol di-p-aminobenzoate (VERSALINK 740M), and mixtures thereof. Preferably, the curing agent of the present invention includes 3,5-dimethylthio-2,4-toluenediamine and isomers thereof, such as ETHACURE 300, commercially available from Albermarle Corporation of Baton Rouge, La. Suitable polyamine curatives, which include both primary and secondary amines, preferably have molecular weights ranging from about 64 to about 2000. Preferably, n and m, each separately, have values of 1, 2, or 3, and preferably, 1 or 2.

At least one of a diol, triol, tetraol, hydroxy-terminated, may be added to the aforementioned polyurethane composition. Suitable hydroxy-terminated curatives have the following general chemical structure:

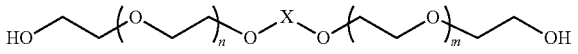

where n and m each separately have values of 0, 1, 2, or 3, and where X is ortho-phenylene, meta-phenylene, para-phenylene, ortho-cyclohexyl, meta-cyclohexyl, or para-cyclohexyl, or mixtures thereof. Preferably, n and m, each separately, have values of 1, 2, or 3, and more preferably, 1 or 2.

Preferred hydroxy-terminated curatives for use in the present invention include at least one of 1,3-bis(2-hydroxyethoxy)benzene and 1,3-bis-[2-(2-hydroxyethoxy)ethoxy] benzene, and 1,3-bis-{2-[2-(2-hydroxyethoxy)ethoxy] ethoxy}benzene; 1,4-butanediol; resorcinol-di-(β-hydroxyethyl)ether; and hydroquinone-di-(β-hydroxyethyl) ether; and mixtures thereof. Preferably, the hydroxy-terminated curatives have molecular weights ranging from about 48 to 2000. It should be understood that molecular weight, as used herein, is the absolute weight average molecular weight and would be understood as such by one of ordinary skill in the art. Both the hydroxy-terminated and amine curatives can include one or more saturated, unsaturated, aromatic, and cyclic groups. Additionally, the hydroxy-terminated and amine curatives can include one or more halogen groups. Suitable diol, triol, and tetraol groups include ethylene glycol, diethylene glycol, polyethylene glycol, propylene glycol, polypropylene glycol, lower molecular weight polytetramethylene ether glycol, and mixtures thereof. The polyurethane composition can be formed with a blend or mixture of curing agents. If desired, however, the polyurethane composition may be formed with a single curing agent.

Any method available to one of ordinary skill in the art may be used to combine the polyisocyanate, polyol, and curing agent of the present invention. One commonly employed method, known in the art as a one-shot method, involves concurrent mixing of the polyisocyanate, polyol, and curing agent. This method results in a mixture that is inhomogenous (more random) and affords the manufacturer less control over the molecular structure of the resultant composition. A preferred method of mixing is known as the prepolymer method. In this method, the polyisocyanate and the polyol are mixed separately prior to addition of the curing agent. This method affords a more homogeneous mixture resulting in a more consistent polymer composition.

An optional, but preferred, filler component may be chosen to adjust the density of the blends described herein. The selection of such filler(s) is dependent upon the type of golf ball desired (i.e., one-piece, two-piece multi-component, or wound), and any filler available to one of ordinary skill in the art is suitable for use according to the invention. Examples of useful fillers include zinc oxide ("ZnO"), barium sulfate, calcium oxide, calcium carbonate, and silica, as well as any salts and oxides thereof. Additional fillers, such as foaming agents, glass and/or plastic microspheres, and various metals, can be added to the polyurethane compositions of the present invention, in amounts as needed, for their well-known purposes. Additional components which can be added to the polyurethane composition include UV stabilizers and other dyes, as well as optical brighteners, fluorescent pigments, and dyes. Such additional ingredients may be added in any amounts that will achieve their desired purpose.

In one embodiment, the invention is a multilayer golf ball that includes a core, an inner cover layer, and an outer cover layer. The cover thickness should be at least about 0.02 inches. Preferably, the outer cover layer has a thickness of between about 0.02 and about 0.1 inches, more preferably from about 0.02 to about 0.08 inches. Most preferably, the thickness is from about 0.03 to 0.05 inches.

As discussed herein, the outer cover layer is preferably formed from a relatively soft polyurethane material. In particular, the material of the outer cover layer should have a material hardness, as measured by ASTM D2240-00, of less than about 80 Shore D, preferably less than about 70 Shore D, more preferably less than about 60 Shore D, and most preferably from about 20 Shore C to about 55 Shore D.

The inner cover layer of the present invention, when included, may be formed of any material available to one of ordinary skill in the art, including the polyurethane composition of the present invention, but it is preferably formed from a hard, high flexural modulus, resilient material. Preferably, the material of the inner cover layer has a material hardness, as measured by ASTM D2240-00, of about 20 to about 80 Shore D, more preferably about 40 to about 70 Shore D, and most preferably about 60 Shore D to about 70 Shore D. The thickness of the inner cover layer will typically be less than about 0.1 inches, but preferably ranges from about 0.01 inches to about 0.08 inches, more preferably from about 0.02 inches to about 0.06 inches, and most preferably from about 0.03 to about 0.04 inches.

The optional inner cover layer may be formed from a wide variety of relatively hard (greater than about 60 Shore D), high flexural modulus (greater than about 55,000 psi) resilient materials. Preferably, the optional inner cover layers have a material hardness of at least about 65 Shore D and more preferably, between about 65 to about 75 Shore D.

Among the preferred inner cover materials are hard, high flexural modulus ionomer resins and blends thereof. These ionomers can be obtained by providing a cross metallic bond to polymers of mono-olefin with at least one member selected from the group consisting of unsaturated mono- or di-carboxylic acids having 3 to 12 carbon atoms and esters thereof (the polymer contains about 1 to 50% by weight of the unsaturated mono- or di-carboxylic acid and/or ester thereof). More particularly, such acid-containing ethylene copolymer ionomer component includes E/X/Y copolymers where E is ethylene, X is a softening comonomer such as acrylate or methacrylate present in 0 to about 50 (preferably 0 to about 25, most preferably 0 to about 20), weight percent of the polymer, and Y is acrylic or methacrylic acid present in about 5 to 35 (preferably at least about 16, more preferably at least about 16 to 35, most preferably at least about 16 to 20) weight percent of the polymer, wherein the acid moiety is neutralized about 1 to 90% (preferably at least about 40%, most preferably at least about 60%) by a cation such as lithium, sodium, potassium, magnesium, calcium, barium, lead, tin, zinc, or aluminum, or a combination of such cations, to form an ionomer. Exemplary acid-containing ethylene copolymers include ethylene/acrylic acid, ethylene/methacrylic acid, ethylene/acrylic acid/n-butyl acrylate, ethylene/methacrylic acid/n-butyl acrylate, ethylene/methacrylic acid/iso-butyl acrylate, ethylene/acrylic acid/iso-butyl acrylate, ethylene/methacrylic acid/n-butyl methacrylate, ethylene/acrylic acid/methyl methacrylate, ethylene/acrylic acid/methyl acrylate, ethylene/methacrylic acid/methyl acrylate, ethylene/methacrylic acid/methyl methacrylate, and ethylene/acrylic acid/n-butyl methacrylate. Preferred acid-containing ethylene copolymers include ethylene/methacrylic acid, ethylene/acrylic acid, ethylene/methacrylic acid/n-butyl acrylate, ethylene/acrylic acid/n-butyl acrylate, ethylene/methacrylic acid/methyl acrylate and ethylene/acrylic acid/methyl acrylate copolymers. The most preferred acid-containing ethylene copolymers are ethylene/methacrylic acid, ethylene/acrylic acid, ethylene/(meth)acrylic acid/n-butyl acrylate, ethylene/(meth) acrylic acid/ethyl acrylate, and ethylene/(meth) acrylic acid/methyl acrylate copolymers. Such ionomer resins are commercially available, for example, from E.I. DuPont de Nemours and Co. under the tradename SURLYN, and from Exxon under the tradename IOTEK. Some particularly suitable SURLYNS include SURLYN 8140 and SURLYN 8546, each of which has a methacrylic acid content of about 19%.

The materials for the inner cover layer, however, are not limited to ionomer resins. Instead, the present invention contemplates that virtually any relatively hard, high flexural modulus, resilient material known to one of ordinary skill in the art that is compatible with the other materials of the golf ball may be employed as the inner cover layer. Examples of other suitable inner cover materials include thermoplastic or thermoset polyurethanes, thermoplastic or thermoset polyetheresters or polyetheramides, thermoplastic or thermoset polyester, a dynamically vulcanized elastomer, a functionalized styrene-butadiene elastomer, a metallocene polymer, or blends thereof.

Suitable thermoplastic polyetheresters include materials which are commercially available from DuPont under the tradename HYTREL. Suitable thermoplastic polyetheramides include materials which are available from Elf-Atochem under the tradename PEBAX. Other suitable materials for the inner cover layer include polycarbonates, polyimides, nylons, polyamides, polyureas, epoxies, urethane ionomers, acrylonitrile-butadiene-styrene copolymer, polysulfones, and thermoplastic and thermoset polyurethanes, and combinations thereof.

In a particularly preferred embodiment of the present invention, the core is a large, solid core, having a compression of less than about 80. A large core, as used herein, is defined as having a diameter of at least about 1.500 inches.

The materials for solid cores include compositions having a base rubber, a crosslinking agent, a filler, and a co-crosslinking or initiator agent. The base rubber typically includes natural or synthetic rubbers. A preferred base rubber is 1,4-polybutadiene having a cis-structure of at least 40%. If desired, the polybutadiene can also be mixed with other elastomers known in the art such as natural rubber, polyisoprene rubber and/or styrene-butadiene rubber in order to modify the properties of the core.

The crosslinking agent preferably includes a metal salt of an unsaturated fatty acid such as a zinc salt or a magnesium salt of an unsaturated fatty acid having 3 to 8 carbon atoms, such as acrylic or methacrylic acid. Suitable cross linking agents include metal salt diacrylates, dimethacrylates, and monomethacrylates, or a mixture thereof, wherein the metal is, for example, magnesium, calcium, zinc, aluminum, sodium, lithium, or nickel, or a mixture thereof.

The initiator agent can be any known polymerization initiator which decomposes during the cure cycle. Suitable initiators include peroxide compounds, such as dicumyl peroxide, 1,1-di(t-butylperoxy) 3,3,5-trimethyl cyclohexane, a-a' bis(t-butylperoxy)diisopropylbenzene, 2,5-dimethyl-2,5 di(t-butylperoxy)hexane, di-t-butyl peroxide, or mixtures thereof.

The core may include about 5 to 50 pph of ZnO in a diacrylate-peroxide core system. Zinc oxide may be used in combination with, or be replaced by, about 5 to 50 pph of calcium oxide in a diacrylate-peroxide system to provide a suitable core composition.

As used herein, the term "filler" in connection with the core includes any compound or composition that can be used to vary the density and other properties of the core. Fillers typically includes materials such as zinc oxide, barium sulfate, silica, calcium carbonate, zinc carbonate, regrind (recycled core material ground to 30 mesh particle) and the like. Any of the fillers described herein with respect to the cover or intermediate layers are also suitable for use in preparing such solid core formulations.

The overall outer diameter of the core, including the center and any intermediate layer(s) or windings, together with the inner cover layer of the golf balls of the present invention, is about 1.51 inches to about 1.64 inches, preferably about 1.59 inches to about 1.63 inches, and most preferably from about 1.60 inches to about 1.62 inches.

The present multilayer golf ball can have an overall diameter of any size. Although the United States Golf Association specifications require the minimum size of a competition golf ball to at least 1.680 inches in diameter, there is no specification as to the maximum diameter. Thus, the preferred diameter of the golf ball of the present invention is about 1.680 inches to about 1.800 inches. The more preferred diameter is from about 1.680 inches to about 1.760 inches. The most preferred diameter is about 1.680 inches to about 1.740 inches.

In another embodiment of the present invention, the anti-counterfeiting system of the present invention may be used in golf equipment and packaging therefor. Examples of golf equipment include, but are not limited to, golf clubs (i.e., putters, drivers, irons, and wedges) and club attachments, additions, or modifications, such as striking face inserts; golf club components (i.e., shafts, hosels, and grips); golf club vibration damping devices; golf gloves and portions thereof, such as glove liners, securing methods, patches, and reinforcements; golf shoes and associated components (i.e., soles, footbeds and spike socket spines, heel counters, toe "puffs," uppers, midsoles, outsoles, liners, and plastic golf spikes); golf bags and their associated framework, support legs, and stands; and any portion of the above items.

In one particular embodiment of the present invention, the cover comprises the polyurethane composition, polyurethane/polyurea blend, or polyurea and polyurethane ionomer compositions.

The term "about," as used herein in connection with one or more numbers or numerical ranges, should be understood to refer to all such numbers, including all numbers in a range.

As used herein, the term "polyurethane composition" refers to a combination of the reaction product of a prepolymer including at least one polyisocyanate and at least one polyol, and at least one curing agent, in addition to the color stabilizer component.

As used herein, the term "ATTI compression" is defined as the deflection of an object or material relative to the deflection of a calibrated spring, as measured with an Atti Compression Gauge, that is commercially available from Atti Engineering Corp. of Union City, N.J. ATTI compression is typically used to measure the compression of a golf ball. However, when referring to the compression of a core, it is preferred to use a compressive load measurement.

The invention described and claimed herein is not to be limited in scope by the specific embodiments herein disclosed, since these embodiments are intended solely as illustrations of several aspects of the invention. Any equivalent embodiments are intended to be within the scope of this invention. Indeed, various modifications of the invention in addition to those shown and described herein will become apparent to those of ordinary skill in the art from the foregoing description. Such modifications are also intended to fall within the scope of the appended claims.

What is claimed is:

1. A golf ball comprising:

a core having a diameter of 1.50 inches or greater;

an intermediate layer;

an outer cover layer comprising a polyurethane or a polyurea material; and an additive, invisible to the naked eye without an external excitation source, the additive comprising a taggant comprising a plurality of inert chemical tracers;

wherein the a combination of the core and the intermediate layer have an outer diameter of 1.51 inches to 1.64 inches and the taggant has at least one excitation wavelength in the infrared spectrum and at least one emission wavelength in the visible spectrum.

2. The golf ball of claim 1, wherein the taggant has an excitation wavelength in the infrared spectrum and an emission wavelength in the visible spectrum.

3. The golf ball of claim 1, wherein the golf ball further comprises an inner cover comprising an ionomer or a partially- or fully-neutralized ionomer, and the outer cover comprises a polyurethane or a polyurea material.

4. The golf ball of claim 3, wherein the inner cover layer has a hardness of 40 Shore D to 75 Shore D.

5. The golf ball of claim 3, wherein the inner cover layer hardness is 65 Shore D to 70 Shore D.

6. The golf ball of claim 3, wherein the inner cover layer has a thickness of 0.02 inches to 0.04 inches.

7. The golf ball of claim 1, wherein the outer cover layer has a hardness of 60 Shore D or less.

8. The golf ball of claim 7, wherein the outer cover layer has a hardness of 20 Shore D to 55 Shore D.

9. The golf ball of claim 1, wherein the outer cover layer has a thickness of 0.02 inches to 0.05 inches.

* * * * *